US008196923B2

(12) United States Patent
Kamiya et al.

(10) Patent No.: US 8,196,923 B2
(45) Date of Patent: Jun. 12, 2012

(54) SKEW-CORRECTING DEVICE AND SHEET-PROCESSING APPARATUS

(75) Inventors: Daisaku Kamiya, Abiko (JP); Kiyoshi Watanabe, Matsudo (JP); Naoto Watanabe, Abiko (JP); Kenichi Tamura, Toride (JP); Takashi Sugiura, Kashiwa (JP); Atsuteru Oikawa, Kawasaki (JP); Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 540 days.

(21) Appl. No.: 11/753,835

(22) Filed: May 25, 2007

(65) Prior Publication Data

US 2007/0273091 A1 Nov. 29, 2007

(30) Foreign Application Priority Data

May 29, 2006 (JP) ..... 2006-148914

(51) Int. Cl.
*B65H 9/00* (2006.01)

(52) U.S. Cl. ..... 271/226; 271/233; 271/243; 270/58.07

(58) Field of Classification Search ..... 271/226, 271/230, 233, 242, 243, 244, 245, 273; 270/58.07, 270/58.12, 58.17
See application file for complete search history.

(56) References Cited

U.S. PATENT DOCUMENTS

| | | | | |
|---|---|---|---|---|
| 5,100,125 | A * | 3/1992 | Uplinger et al. | 271/233 |
| 5,911,414 | A | 6/1999 | Kato | |
| 5,933,697 | A * | 8/1999 | Onodera et al. | 399/406 |
| 6,361,036 | B1 * | 3/2002 | Nakazawa | 270/58.07 |
| 6,719,283 | B2 * | 4/2004 | Tsuchiya et al. | 270/58.07 |
| 7,429,037 | B2 * | 9/2008 | Kawata et al. | 270/37 |
| 7,429,038 | B2 * | 9/2008 | Ruthenberg et al. | 270/59 |

FOREIGN PATENT DOCUMENTS

| | | | |
|---|---|---|---|
| JP | 06100206 | A * | 4/1994 |
| JP | 09-315623 | A | 12/1997 |
| JP | 10-194557 | | 7/1998 |
| JP | 2004-331299 | A | 11/2004 |
| JP | 2005-154073 | | 6/2005 |
| JP | 2006-069785 | A | 3/2006 |

* cited by examiner

*Primary Examiner* — Kaitlin Joerger
(74) *Attorney, Agent, or Firm* — Canon USA Inc IP Division

(57) ABSTRACT

A sheet skew-correcting device includes a sheet-conveying rotation body for conveying a sheet, a skew-correcting member that contacts an end of the sheet conveyed by the sheet-conveying rotation body for correcting skew of the sheet, and a driving unit for moving the skew-correcting member. The skew-correcting member moved in a sheet-conveying direction by the driving unit contacts the end of the sheet conveyed in the sheet-conveying direction by the sheet-conveying rotation body, so as to correct the skew of the sheet.

5 Claims, 12 Drawing Sheets

SKEW-CORRECTING DEVICE AND SHEET-PROCESSING APPARATUS

BACKGROUND OF THE INVENTION

1. Field of the Invention

The present invention relates to a skew-correcting device that corrects skew of a sheet, and a sheet-processing apparatus that processes the sheet with the skew thereof corrected by the skew-correcting device.

2. Description of the Related Art

An example of a sheet-processing apparatus includes a puncher that punches a sheet having an image formed by an apparatus body of an image forming apparatus (see Japanese Patent Laid-Open No. 10-194557, corresponding to U.S. Pat. No. 5,911,414)). The image forming apparatus may be a copier, a printer, a facsimile, or a multi function peripheral.

The puncher punches the sheet after the skew of the sheet is corrected by the skew-correcting device. The skew correction of the sheet means that the sheet inclined relative to a sheet-conveying direction is corrected to be along the sheet-conveying direction.

FIG. 12 is an illustration showing a puncher 410. The puncher 410 is disposed in a sheet-conveying path 430. A sheet P is punched using a punch 411, which is linearly movable in a reciprocating manner in a direction indicated by an arrow A, and a fixed die 412, after the skew of the sheet P is corrected by a skew-correcting device 401. The puncher 410 punches the sheet P by moving in a reciprocating manner.

The skew of the sheet is corrected as follows. The sheet P conveyed by an upstream conveying roller pair 406 is continuously conveyed by a conveying roller pair 405. When the rear end (lower end in the drawing, i.e., the upstream end in the conveying direction) of the sheet P passes through a rear-end stopper 421, the rear-end stopper 421 is rotated from a standby position plotted by the broken line to a receiving position plotted by the solid line. Then, the conveying roller pair 405 rotated forward in a direction indicated by an arrow B is rotated backward in a direction indicated by an arrow C, to feed the sheet backward. The rear-end stopper 421 at the receiving position receives the rear end of the sheet. This corrects the skew of the sheet at the rear end side thereof.

After the skew at the rear end side of the sheet is corrected, the puncher 410 makes holes at a portion of the rear end side.

The skew-correcting device 401 shown in FIG. 12 corrects the skew of the sheet by conveying the sheet in the direction opposite to the conveying direction once, so that the rear-end stopper 421 comes into contact with the rear end of the sheet. Therefore, the conveyance of the sheet is intermitted for the skew correction. This degrades the efficiency of the skew correction of the skew-correcting device 401.

Another example of the mechanism for correcting the skew of the sheet uses a shutter as disclosed in Japanese Patent Laid-Open No. 2005-154073. The skew of the sheet is corrected as a front end of the sheet conveyed by a sheet-conveying unit comes into contact with the shutter. The front end of the sheet is corrected by the shutter, and the sheet is conveyed while the sheet pushes and moves the shutter. In other words, the shutter is pushed and rotated by the sheet to be conveyed. With this mechanism, the hardness of the sheet to be conveyed by the sheet-conveying unit is utilized for moving the shutter against a force, for example, caused by a spring that biases the shutter. If a sheet with a small degree of hardness can move the shutter, a sheet with a large degree of hardness possibly moves the shutter even before the skew of the sheet is reliably corrected. Thus, it is difficult to correspond to various types of sheets having different levels of hardness while providing highly accurate skew correction.

SUMMARY OF THE INVENTION

The present invention is directed to a skew-correcting device that corrects skew of a sheet accurately and efficiently.

According to an aspect of the present invention, a sheet skew-correcting device includes a sheet-conveying unit configured to convey a sheet in a sheet-conveying direction; a skew-correcting member configured to contacts an end of the sheet being conveyed by the sheet-conveying unit so as to correct skew of the sheet; and a driving unit configured to move the skew-correcting member in the sheet-conveying direction so that the skew-correcting member contacts the end of sheet being conveyed in the sheet conveying direction by the sheet-conveying unit.

Further features of the present invention will become apparent from the following description of exemplary embodiments with reference to the attached drawings.

DESCRIPTION OF THE EMBODIMENTS

First Embodiment

A skew-correcting device according to embodiments of the present invention, a sheet-processing apparatus having the skew-correcting device, and an image forming apparatus having the sheet-processing apparatus are described below with reference to the attached drawings.

[Copier]

The configuration of a copier as an image forming apparatus is described.

Figure 11:
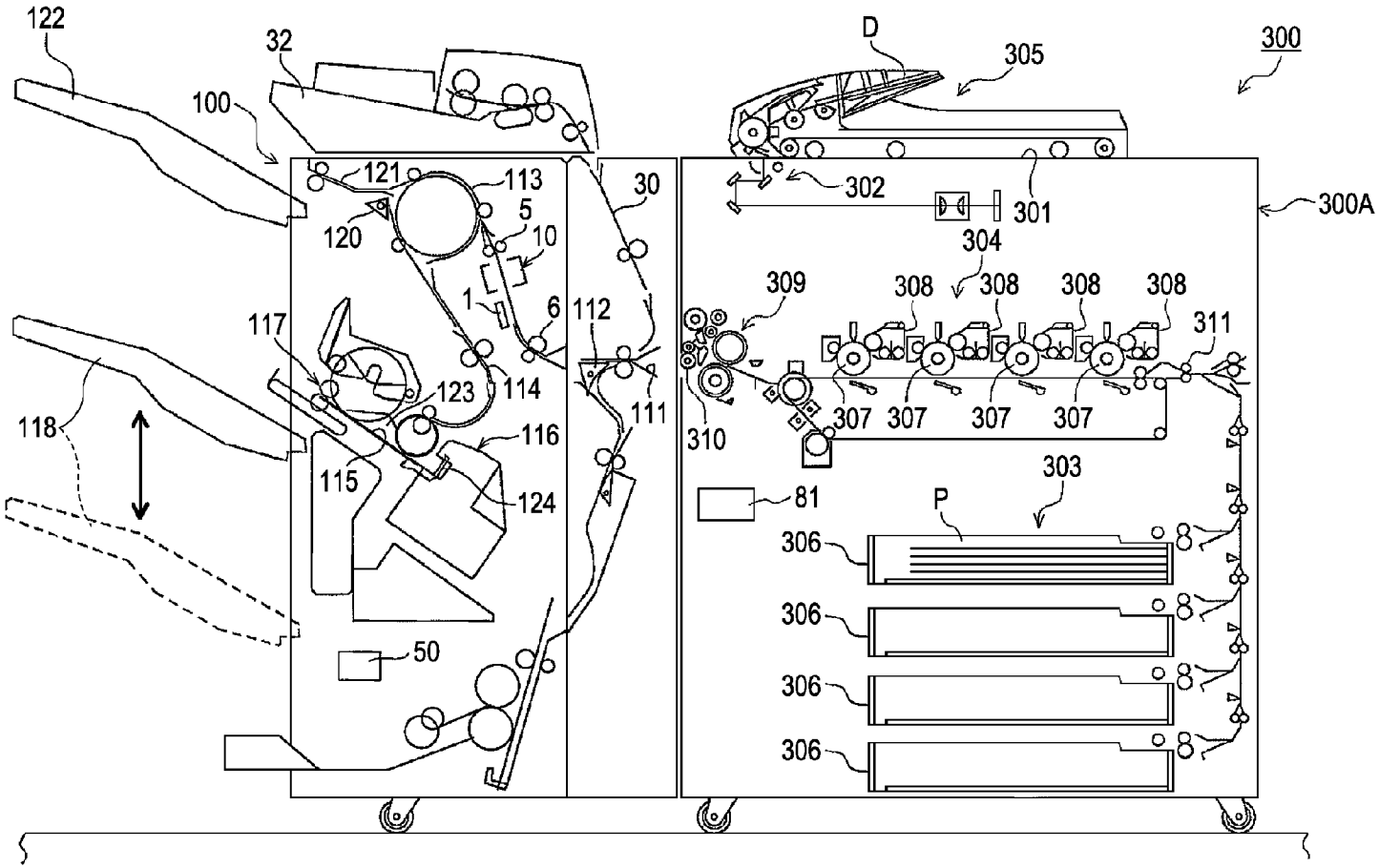
FIG. 11 is a cross-sectional view showing a copier as an image forming apparatus according to an embodiment of the present invention taken along a sheet-conveying direction of the copier.

FIG. 11 is a cross-sectional view showing the copier taken along a sheet-conveying direction. While the image forming apparatus according to the present embodiment is a multicolor copier, the image forming apparatus may include a monochrome copier, a printer, a facsimile, or a multi function peripheral. Thus, the image forming apparatus of the present invention is not limited to the multicolor copier.

A copier 300 includes an apparatus body 300A, a sheet-processing apparatus 100, and an inserter 32. The apparatus body 300A includes a platen glass 301 as an original document table, a light source, a lens system 302, a paper-feeding unit 303, and an image forming section 304.

Also, an automatic document feeder (ADF) 305 is provided at the top of the apparatus body 300A. The ADF 305 automatically feeds an original document D to the platen glass 301. If not necessary, the ADF 305 may be omitted.

The paper-feeding unit 303 provided in the apparatus body 300A has a cassette 306 that accommodates recording sheets P and is mounted to the apparatus body 300A in a detachably attached manner. The image forming section 304 as an image forming unit includes a cylindrical photosensitive drum 307 and a developing unit 308 disposed at the periphery of the photosensitive drum 307. A fixer 309, a discharging roller pair 310, and the like, are disposed downstream of the image forming section 304.

The sheet-processing apparatus 100 is arranged adjacent to the apparatus body 300A. The sheet-processing apparatus 100 processes the sheet having an image formed thereon and conveyed from the apparatus body 300A.

The sheet-processing apparatus 100 includes a stapler unit 116, and a puncher 10 as a processing unit that makes holes in a sheet.

The inserter 32 is disposed on the top of the sheet-processing apparatus 100. The inserter 32 feeds a sheet that is not necessary to pass through the apparatus body 300A of the copier 300, such as a normal sheet, a preprinted sheet, a color sheet, a special sheet, a sheet folded in two, and a sheet folded in three. The inserter 32 also feeds a sheet that may not pass through the apparatus body 300A of the copier 300, to the sheet-processing apparatus 100.

The operation of the copier 300 is described.

When the apparatus body 300A outputs a paper-feed signal, the paper-feeding unit 303 feeds a sheet P from the cassette 306. Meanwhile, the light source emits light to an original document set on the platen glass 301. The emitted light is reflected, passes through the lens system 302 and a controller (not shown), is converted into laser beam by a laser beam scanner, and irradiates the photosensitive drum 307 as the laser beam. The photosensitive drum 307 is previously charged by a primary charger, and hence, when the laser beam is emitted, an electrostatic latent image is formed. The electrostatic latent image is developed by the developing unit 308 and becomes a toner image.

The skew of the sheet P fed from the paper-feeding unit 303 is corrected by a registration roller pair 311, then the position of the sheet P is aligned corresponding to the toner image formed on the photosensitive drum 307, and the sheet P is conveyed to the image forming section 304. The image forming section 304 transfers the toner image on the sheet P. The toner image transferred on the sheet P is permanently fixed to the sheet P by the fixer 309. The discharging roller pair 310 conveys the sheet P having the toner image fixed thereto, from the apparatus body 300A to the sheet-processing apparatus 100.

The sheet P conveyed from the apparatus body 300A of the copier 300 passes through a conveyance relay portion 111 of the sheet-processing apparatus 100, and is conveyed to the sheet-processing apparatus 100. When no processing is applied to the sheet P, the sheet P is guided to an upstream conveying path switching flapper 112, an upper guide 113, a downstream conveying path switching flapper 120, and then an upper tray guide 121. The sheet P is finally set on an upper supporting tray 122. When holes are made in the sheet, the puncher 10 makes the holes in the middle of a path between the upstream conveying path switching flapper 112 and the upper guide 113.

Sheets P to be bound in a sheet bundle, pass through the upstream conveying path switching flapper 112, the upper guide 113, the downstream conveying path switching flapper 120, and a conveying guide 114. Then, the sheet bundle is discharged on a processing tray 115.

The rear end of the sheet bundle discharged on the processing tray 115 is received by a rear-end stopper 124, and the position of the rear end is aligned. Then, a sheet-width alignment plate 123 aligns the width of the sheet bundle. When the sheet bundle with a predetermined number of sheets is set on the processing tray 115, the stapler unit 116 binds the sheet bundle. Then, a discharging roller pair 117 discharges the sheet bundle on a lower supporting tray 118.

The puncher 10 is a rotatable puncher, and is disposed at a position between the conveyance relay portion 111 and the upper guide 113.

Figure 1:
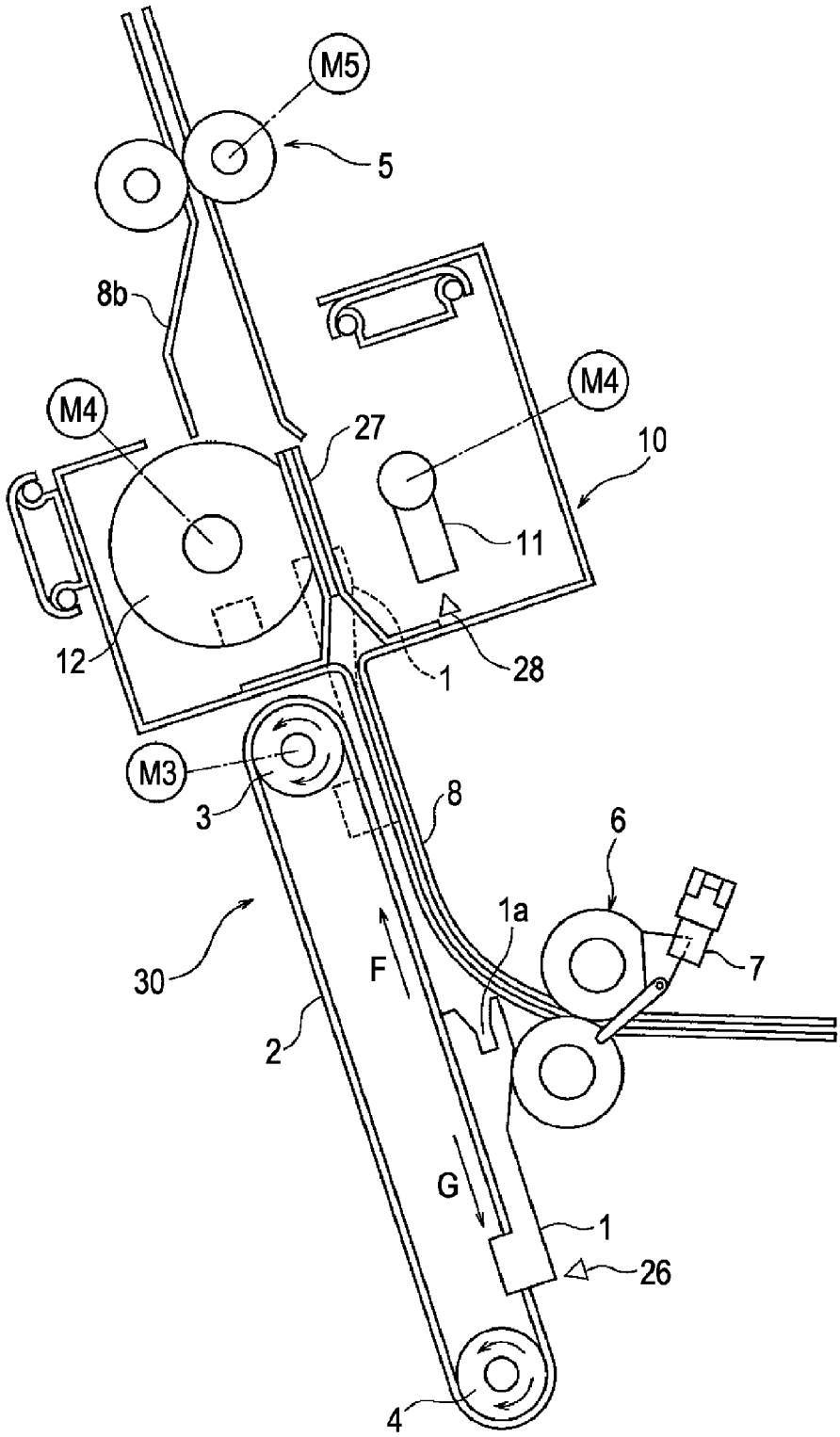
FIG. 1 is an enlarged view showing a sheet-processing apparatus according to an embodiment of the present invention.
Figure 2:
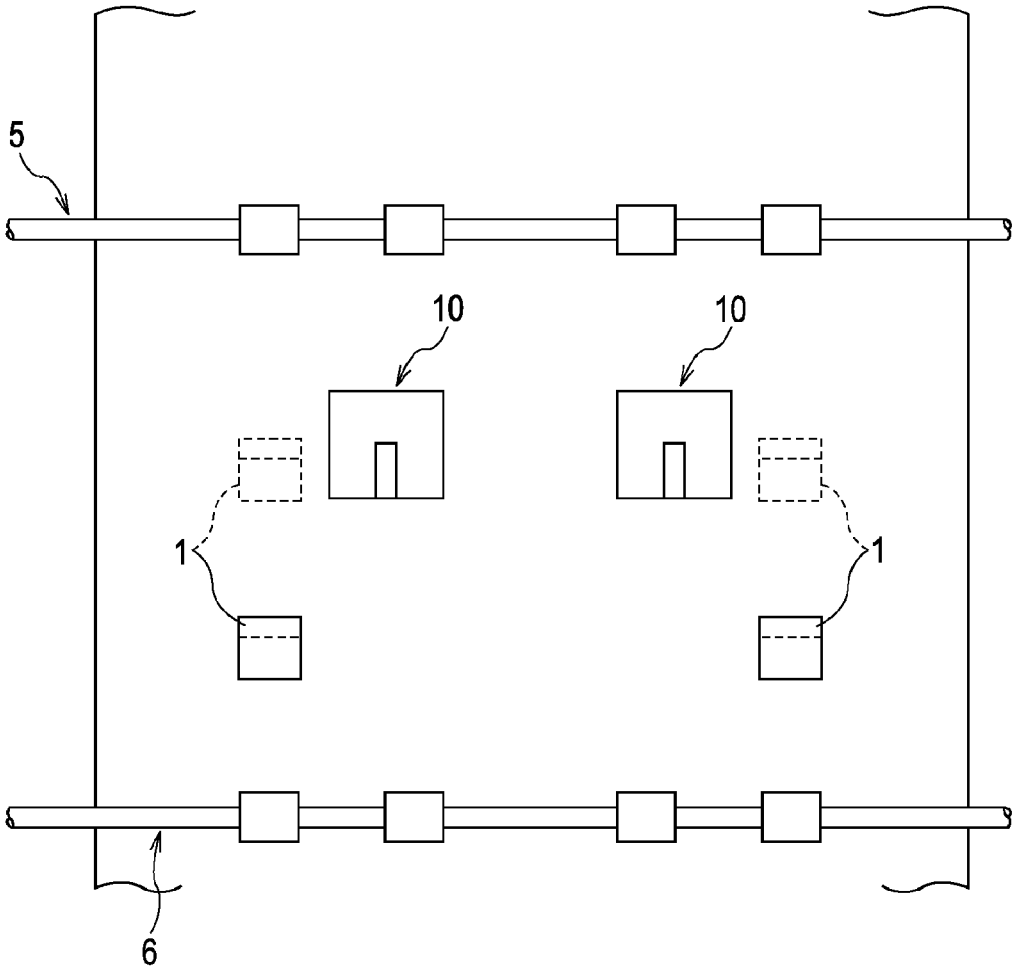
FIG. 2 is a schematic illustration showing the right side of FIG. 1.

As shown in FIG. 1, pulleys 3 and 4, and a timing belt 2 extending over the pulleys 3 and 4 are disposed upstream of the puncher 10. The pulleys 3 and 4 are rotated forward and backward in directions indicated by arrows F and G by way of a skew-correcting member driving motor M3. A skew-correcting member 1 is fixed at the timing belt 2 as a contact member that comes into contact with an end of a sheet. The skew-correcting member 1 is advanced and retracted relative to a conveying guide 8 when a circulating direction of the timing belt 2 is changed. As shown in FIG. 2, a pair of the skew-correcting members 1 is disposed on both sides of the puncher 10 and moved up and down synchronously.

Figure 10:
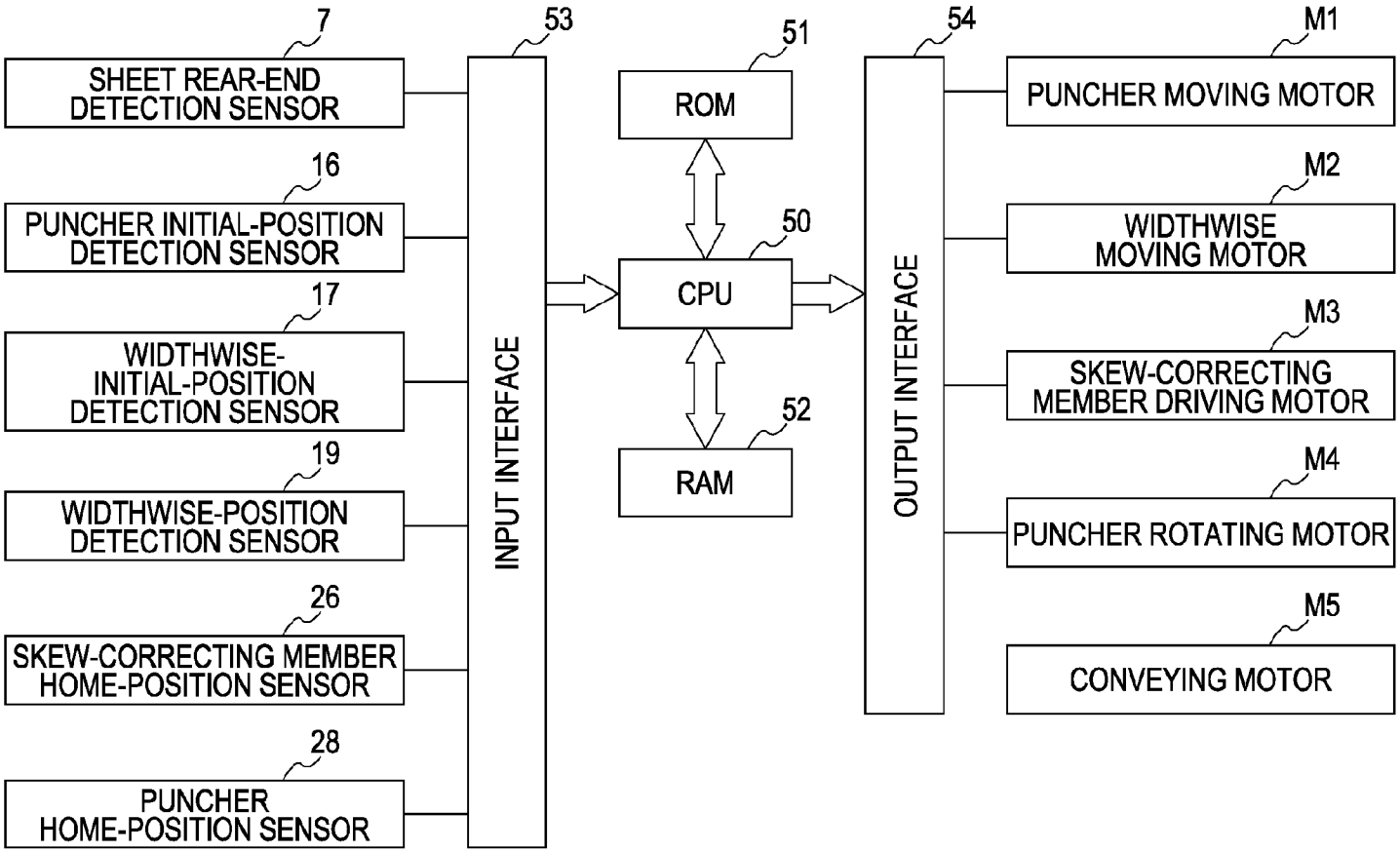
FIG. 10 is a block diagram showing the control of the sheet-processing apparatus.

FIG. 10 is a block diagram showing the control of the sheet-processing apparatus 100. The control system of the sheet-processing apparatus 100 can use a microcomputer system. The microcomputer system includes a CPU 50, a ROM 51, and a RAM 52. The ROM 51 stores in advance a puncher-processing program, a stapling-processing program, and the like. The CPU 50 executes the programs, and performs input data processing while exchanging data with the RAM 52. By transmitting and receiving predetermined control signals, the CPU 50 controls various units.

The CPU 50 acquires signals as input data from sensors (described below) via an input interface circuit 53. In particular, the CPU 50 acquires signals input by a sheet-rear-end detection sensor 7, a puncher initial-position detection sensor 16, a widthwise-initial-position detection sensor 17, a widthwise-position detection sensor 19, a skew-correcting member home-position sensor 26, a puncher home-position sensor 28, and the like.

The CPU 50 transmits control signals to control devices (motor driver and the like) via an output interface circuit 54 so as to control the control devices. The control devices include a puncher-moving motor M1, a widthwise moving motor M2, a skew-correcting member driving motor M3, a puncher-rotating motor M4, and the like.

The CPU 50 of the sheet-processing apparatus 100 transmits and receives signals to and from a CPU 81 that controls the apparatus body 300A of the copier 300 shown in FIG. 11. The CPU 81 transmits information including the size of an original document, the number of copies of an original document provided by the ADF 305, etc. to the CPU 50. Note that the CPUs 50 and 81 may be integrated.

In the above-described configuration, the skew-correcting member driving motor M3, the pulleys 3 and 4, the timing belt 2, the skew-correcting member 1, the downstream conveying roller pair 5 (sheet conveying unit), and the like, define a skew correcting device 30. The combination consisting of the skew-correcting member driving motor M3, the pulleys 3 and 4, and the timing belt 2, is merely an example of the driving unit for moving each skew-correcting member 1.

The operation of the sheet-processing apparatus 100 is described with reference to FIGS. 3A to 3D.

Figure 3A:
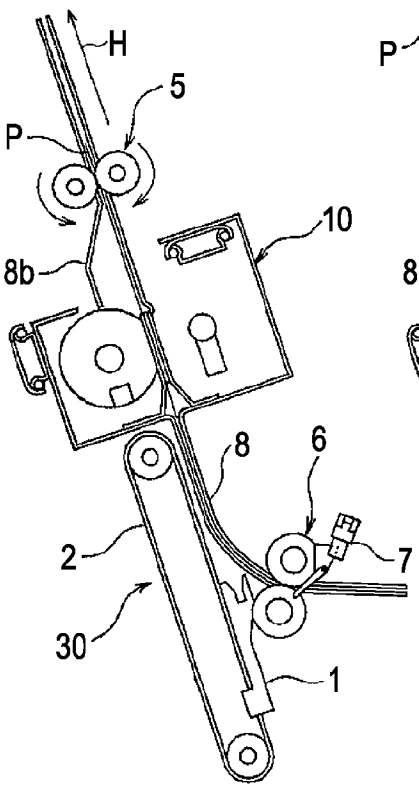
FIG. 3A is an explanatory view showing the operation of the sheet-processing apparatus, in a state where a sheet is conveyed through a conveying guide.
Figure 3B:
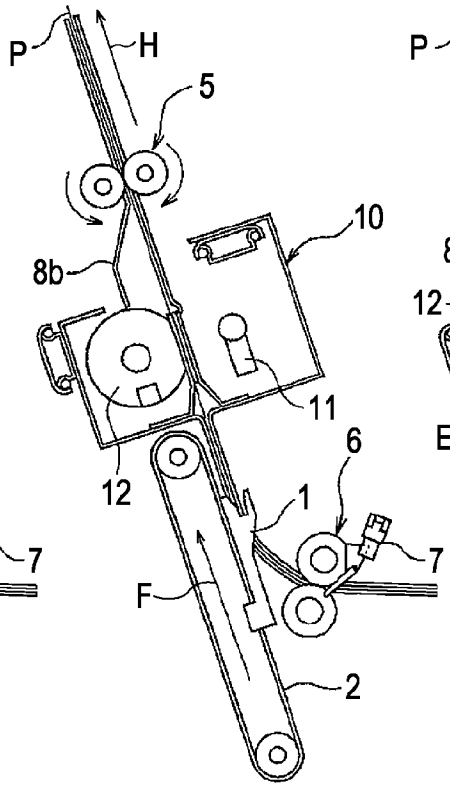
FIG. 3B is an explanatory view showing the operation of the sheet-processing apparatus, in a state where a skew-correcting member starts moving in a direction indicated by an arrow F at a predetermined timing after the rear end of the sheet passes through a sheet-rear-end detection sensor.
Figure 3C:
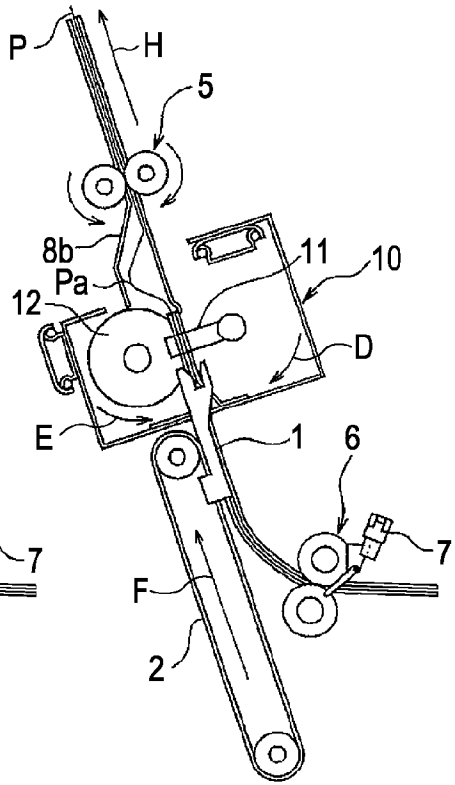
FIG. 3C is an explanatory view showing the operation of the sheet-processing apparatus, in a state where a rotatable puncher makes holes at predetermined positions when the skew-correcting member pushes the rear end of the sheet and the skew of the sheet is corrected.

FIG. 3A is an illustration showing a state where a sheet P is conveyed through the conveying guide 8 in a direction indicated by the arrow H. FIG. 3B is an illustration showing a state where the skew-correcting member 1 starts moving in a direction indicated by the arrow F at a predetermined timing after the rear end of the sheet passes through the sheet-rear-end detection sensor 7. FIG. 3C is an illustration showing a state where the rotatable puncher 10 makes holes at predetermined positions of the sheet P when the skew-correcting member 1 pushes the rear end of the sheet P and the skew of the sheet P is corrected.

As shown in FIG. 3A, the sheet P is conveyed through the conveying guide 8. The upstream conveying roller pair 6 feeds the sheet P to the puncher 10, and conveys the sheet P to the downstream conveying roller pair 5. The upstream conveying roller pair 6 and the downstream conveying roller pair 5 successively convey the sheet P.

The sheet-rear-end detection sensor 7 detects the rear end (upstream end) of the sheet P. The CPU 50 activates the skew-correcting member driving motor M3 when a predetermined period of time has elapsed after the sheet-rear-end detection sensor 7 detects the rear end of the sheet, so that the skew-correcting member 1 is moved toward the downstream side (in the direction indicated by the arrow F).

The skew-correcting member 1 is in a standby state at a home position while the skew-correcting member home-position sensor 26 detects the skew-correcting member 1. When the rear end of the sheet passes through the upstream conveying roller pair 6 and reaches a point where the rear end of the sheet faces the sheet receiving portion 1*a* of the skew-correcting member 1, the skew-correcting member 1 is moved toward the downstream side.

As shown in FIG. 3B, the front end of the sheet P is nipped and conveyed by the downstream conveying roller pair 5, the rear end (upstream end) of the sheet is received by the sheet receiving portion 1*a* of the skew-correcting member 1, and the sheet P is pushed by the skew-correcting member 1 when being conveyed. That is, the skew-correcting member 1 is moved by the driving unit including the pulleys 3 and 4, the timing belt 2, and the skew-correcting member driving motor M3, so that the sheet receiving portion 1*a* of the skew-correcting member 1 comes into contact with the upstream end of the sheet that is conveyed in the conveying direction by the downstream conveying roller pair 5. The sheet receiving portion 1*a* receives the sheet such that the upstream end of the sheet is orthogonal to the sheet-conveying direction.

A moving speed V1 of the skew-correcting member 1, which is moved by the skew-correcting member driving motor M3, is higher than a sheet-conveying speed V2 of the downstream conveying roller pair 5 that is rotated by the conveying motor M5 (V1>V2).

Figure 4:
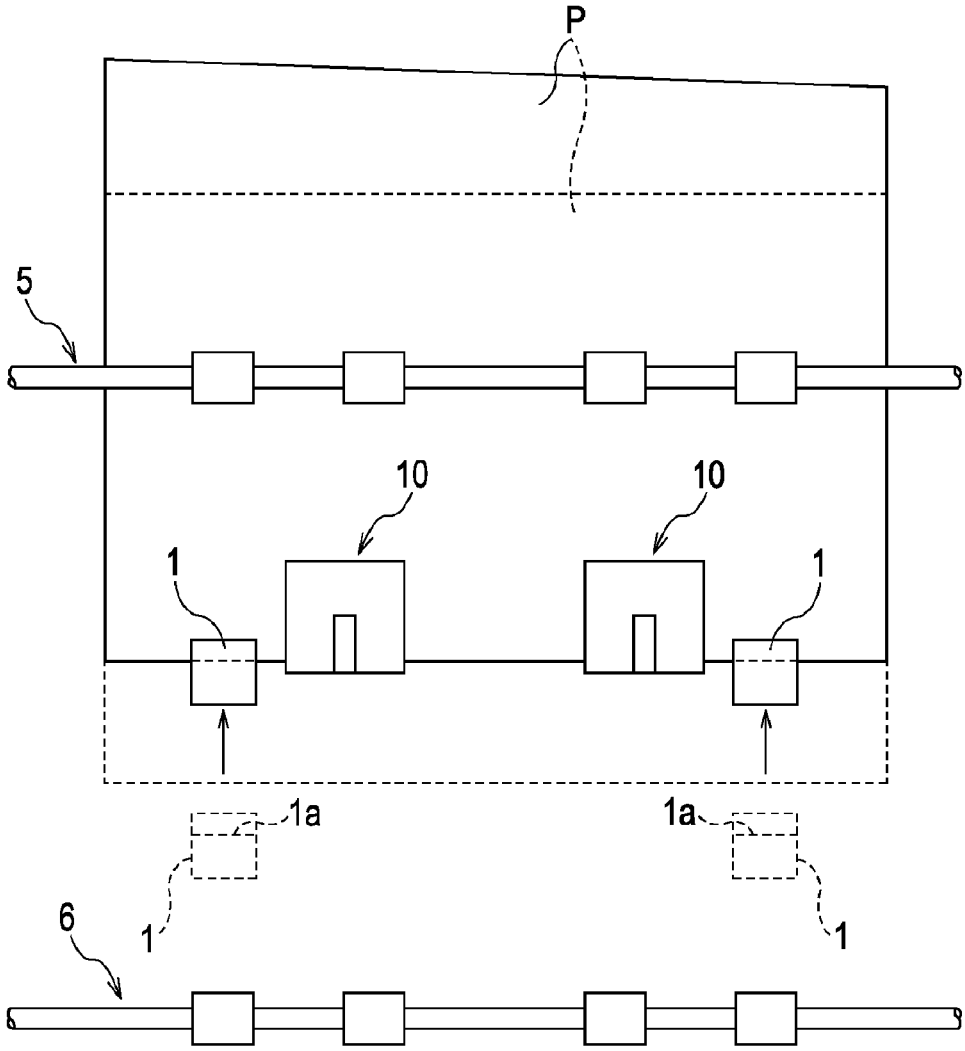
FIG. 4 is a right side view showing the sheet-processing apparatus when the sheet-processing apparatus shown in FIG. 1 corrects the skew of the sheet.

Due to this, as shown in FIG. 3C, a loop is formed at the sheet P. The loop is formed in a space 8*b* provided on the downstream side of the puncher 10 in the conveying guide 8. As shown in FIG. 4, the rear end (upstream end) of the sheet having the loop is received by the sheet receiving portion 1*a*. Therefore, even when the sheet is skewed, the rear end of the sheet is aligned to be orthogonal to the sheet-conveying direction. The lateral end of the sheet is corrected to be parallel to the sheet-conveying direction.

While the loop is formed at the sheet, since the sheet is prevented from bending by a pair of guiding plates 27 disposed in the vicinity of a punching unit 11 and a die 12 of the puncher 10. Accordingly, a portion of the sheet to be punched does not bend.

After the skew of the sheet is corrected, the CPU 50 activates the puncher-rotating motor M4. The punching unit 11 and the die 12 are rotated and make holes in the sheet. The sheet P is punched at a portion close to the skew-correcting member 1 relative to the loop Pa. The portion of the sheet to be punched does not have the loop, and hence, is prevented from bending because of the guiding plates 27. Even if the guiding plates 27 are not provided, the puncher 10 can make holes accurately at desired positions in the sheet because the puncher 10 makes holes at the portion close to the rear end of the sheet and having a small degree of bending of the loop.

Figure 3D:
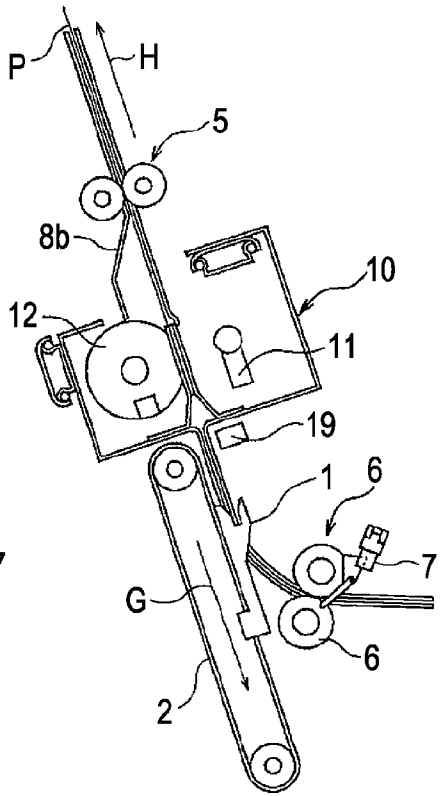
FIG. 3D is an explanatory view showing the operation of the sheet-processing apparatus in a state where the skew-correcting member returns to a home position thereof.

When the holes are made in the sheet, as shown in FIG. 3D, the skew-correcting member 1 is retracted in the direction indicated by the arrow G. The sheet is conveyed by the downstream conveying roller pair 5.

As described above, since the skew-correcting device 30 forms the loop at the sheet by utilizing the difference between the moving speed of the skew-correcting member 1 and the sheet-conveying speed of the downstream conveying roller pair 5, if the skew-correcting member 1 does not convey the upstream end of the sheet to the downstream side, the loop is not formed at the sheet. Since the skew-correcting device 30 can form the loop at the sheet without feeding the sheet backward, and correct the skew of the sheet, skew-correcting efficiency can be increased.

Also, since the sheet-processing apparatus 100 has the skew-correcting device 30 that corrects the skew of the sheet without feeding the sheet backward, and thus having the high skew-correcting efficiency, the sheet-processing apparatus 100 can enhance sheet-processing efficiency.

Since the sheet-processing apparatus 100 has the rotatable puncher 10, the holes can be made in the sheet during the continuous conveyance of the sheet, thereby further enhancing the sheet-processing efficiency.

As shown in FIG. 3C, since the sheet-processing apparatus 100 makes the holes in the sheet at the portion close to the skew-correcting member 1 relative to the loop Pa, and hence having the small degree of bending of the sheet, the holes can be made accurately at the desired positions in the sheet.

In the above description, the loop is formed at the sheet by the skew-correcting member 1 and the downstream conveying roller pair 5. For example, the downstream conveying roller pair 5 may be a slip roller pair so as to allow the sheet to slip, so that the sheet slips during nipping of such a conveying roller pair 5 by the amount of skew correction. Accordingly, not only the skew of the rear end of the sheet, but also the skew of the entire sheet can be corrected. As mentioned in the example of the slip roller pair, the skew correction is easily executed in a case where a frictional force and a nipping force of rollers are determined to allow the sheet to slip relative to the rollers when the rear end of the sheet is pushed. Also, since the skew of the sheet is reliably corrected, the sheet alignment at the processing tray 115 disposed downstream of the puncher 10 is easily executed. The sheet is aligned and stacked on the upper supporting tray 122 or the lower supporting tray 118.

Figure 12:
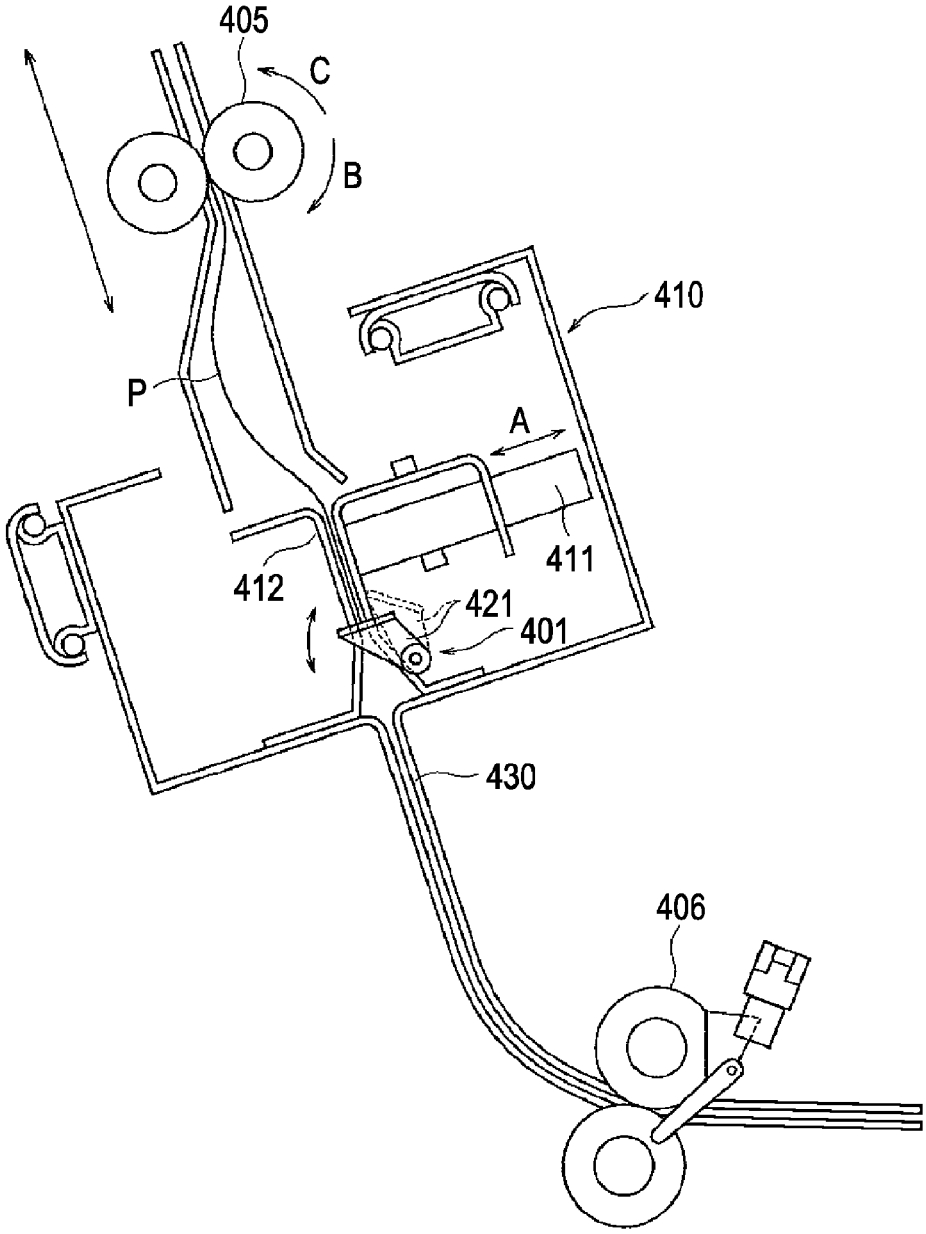
FIG. 12 PRIOR ART
FIG. 12 is a cross-sectional view showing a sheet-processing apparatus of a related art taken along a sheet-conveying direction thereof.

The sheet-processing apparatus 100 may stop the movement of the skew-correcting member 1 while the loop formed at the sheet is eliminated by the rotation of the downstream conveying roller pair 5. Owing to this, the holes may be made in the sheet by a reciprocating puncher of the related art as shown in FIG. 12 instead of the above-described rotatable puncher.

Since the downstream conveying roller pair 5 conveys the downstream end of the sheet for eliminating the loop, the conveying efficiency is not decreased. Thus, the sheet-processing efficiency is not decreased. Since the skew-correcting member 1 is stopped and the holes are made, the holes can be accurately made at predetermined positions.

Further, the sheet-processing apparatus of the present embodiment can easily adjust and change the positions of the holes in the sheet-conveying direction, by changing the stop position of the skew-correcting member 1.

The sheet-processing apparatus of the present embodiment can easily adjust and change the positions of the holes in the sheet-width direction, by moving the puncher 10 in the direction (the sheet-width direction) orthogonal to the sheet-conveying direction during the conveyance of the sheet.

Figure 5:
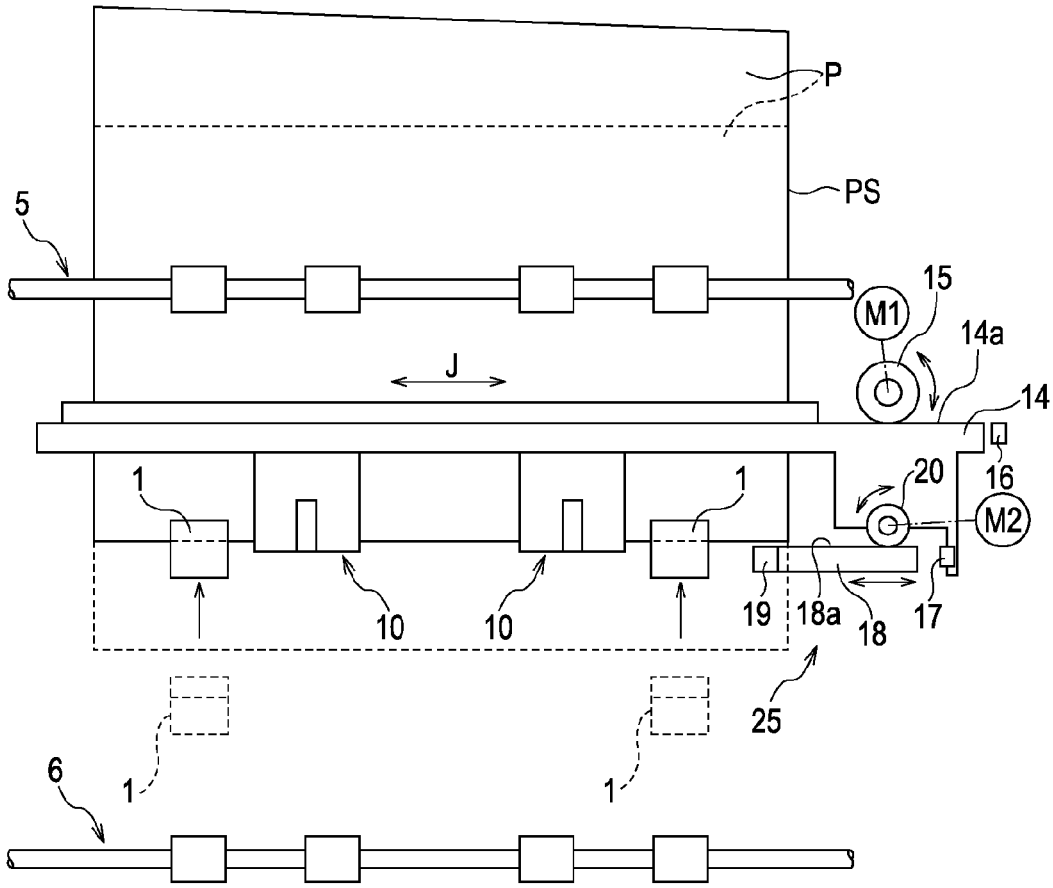
FIG. 5 is an illustration showing a mechanism for adjusting and changing the positions of holes of the puncher in the sheet-width direction.

Next, the adjustment and change of the positions of holes in the sheet-width direction (direction indicated by an arrow J) for the puncher is described with reference to FIG. 5.

A casing 14 of the puncher 10 has a rack gear 14*a*. The rack gear 14*a* is meshed with a pinion gear 15 provided at a fixed member. The pinion gear 15 is rotated by the puncher-moving motor M1. The initial position of the casing 14 is detected by the puncher initial-position detection sensor 16.

When the puncher-moving motor M1 is rotated by the CPU 50, the puncher 10 is moved in the sheet-width direction with the casing 14 by the pinion gear 15 and the rack gear 14*a* so as to change the position thereof in the sheet-width direction.

A sensor arm 18 movable in the sheet-width direction is provided at the casing 14 of the puncher 10. The sensor arm 18 has a rack gear 18*a*. The rack gear 18*a* is meshed with a pinion gear 20 provided at the casing 14. The pinion gear 20 is rotated by the widthwise moving motor M2. The initial position of the sensor arm 18 relative to the casing 14 is detected by the widthwise-initial-position detection sensor 17 provided at the casing 14. The widthwise-position detection sensor 19 is mounted to the sensor arm 18 on the puncher 10 side. The widthwise-position detection sensor 19 detects the lateral end PS of the sheet along the sheet-conveying direction.

The sensor arm 18, the rack gear 18*a*, the pinion gear 20, the widthwise-initial-position detection sensor 17, the widthwise-position detection sensor 19, and the like, define a widthwise-position detecting unit 25.

With the configuration shown in FIG. 5, setting of the positions of the holes relative to the lateral end PS of the sheet, and punching are executed as follows.

The CPU 50 controls the puncher-moving motor M1 to move the casing 14 to the puncher initial-position detection sensor 16, and positions the casing 14 at the initial position relative to the sheet-processing apparatus. Also, the CPU 50 controls the widthwise moving motor M2 to move the sensor arm 18 to the widthwise-initial-position detection sensor 17, and positions the sensor arm 18 at the initial position relative to the casing 14. Accordingly, the interval between the puncher 10 and the widthwise-position detection sensor 19 becomes an initial interval.

Then, the CPU 50 controls the widthwise moving motor M2 to move the sensor arm 18 by the distance corresponding to the distance between the lateral end of the sheet and the punching positions. Accordingly, the interval between the puncher 10 and the widthwise-position detection sensor 19 becomes the interval corresponding to the distance between the lateral end of the sheet and the punching positions.

When the sheet is conveyed, the CPU 50 controls the puncher-moving motor M1 to move the casing 14 in the sheet-width direction. The casing 14 is moved in the sheet-width direction with the widthwise-position detection sensor 19 so as to keep the relative positions of these. When the widthwise-position detection sensor 19 detects the lateral end of the sheet, the CPU 50 stops the puncher-moving motor M1. As a result, the puncher 10 is moved to a predetermined position from the lateral end of the sheet in accordance with the position of the conveyed sheet. Thus, the puncher 10 can make the holes accurately at the predetermined positions in the sheet.

The timing in which the widthwise-position detection sensor 19 detects the lateral end of the sheet should be after the skew-correcting member 1 comes into contact with the rear end of the sheet and the skew of the sheet is corrected. In addition, the movement of the puncher 10 should be completed by the time when the skew-correcting member 1 moves the sheet to the punching position because the processing time can be reduced.

While the widthwise-position detection sensor 19 is moved and the lateral end of the sheet is detected, at least one of the conveying roller pairs 5 and 6 may be moved, and the sheet may be moved to the widthwise-position detection sensor 19, so as to detect the lateral end of the sheet.

As mentioned above, the downstream conveying roller pair 5 may be a slip roller pair for easily correcting the skew of the sheet. Alternatively, the skew can be easily corrected by a configuration that releases the nipping of the downstream conveying roller pair 5 instead of using the slip roller pair.

Figure 6A:
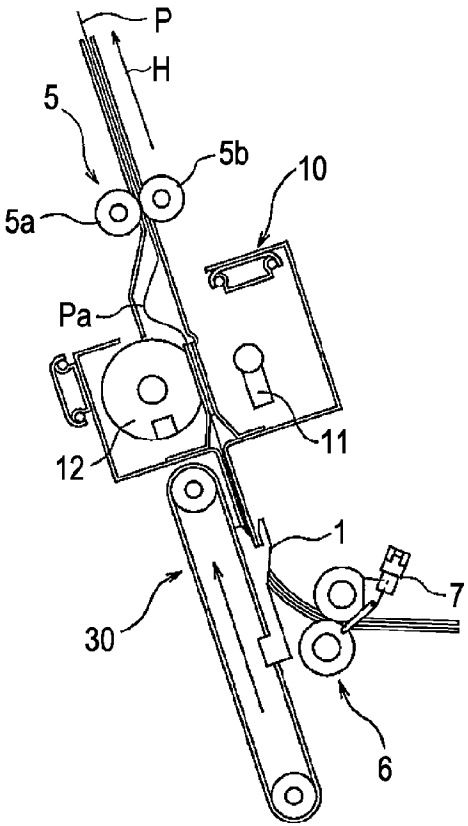
FIG. 6A is an explanatory view showing the operation of a sheet-processing apparatus according to another embodiment, in a state where a sheet is conveyed through a conveying guide.

In particular, as shown in FIG. 6A, the skew-correcting member 1 comes into contact with the rear end (lower end) of the sheet to form the loop Pa at the sheet P, and starts correcting the skew of the sheet P.

Figure 6B:
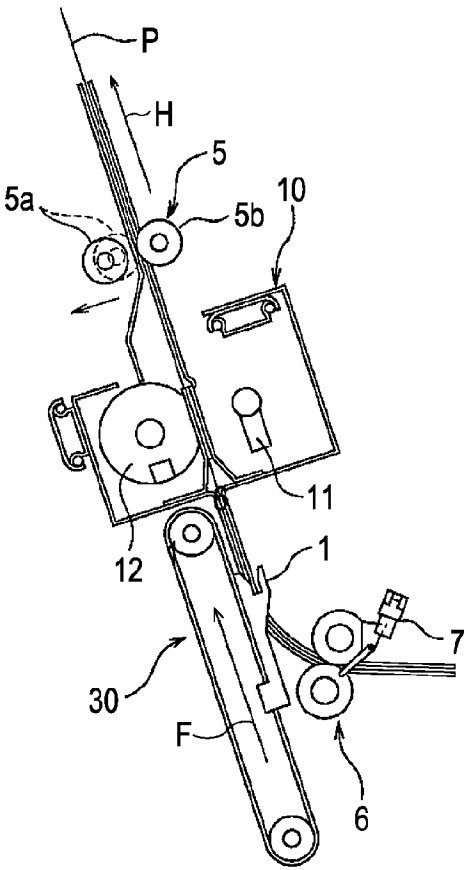
FIG. 6B is an explanatory view showing the operation of the sheet-processing apparatus according to the embodiment, in a state where a skew-correcting member starts moving in a direction indicated by the arrow F at a predetermined timing after the rear end of the sheet passes through a sheet-rear-end detection sensor.

Then, as shown in FIG. 6B, one conveying roller 5*a* of the downstream conveying roller pair 5 comes away from the other conveying roller 5*b*, to release the nipping of the downstream conveying roller pair 5. Accordingly, the loop formed at the sheet is eliminated. At this time, the skew-correcting member 1 continues conveying the sheet in a direction indicated by the arrow H. This allows the skew correction to be easily executed by the skew-correcting member 1 while the sheet is not held by the downstream conveying roller pair 5.

Figure 6C:
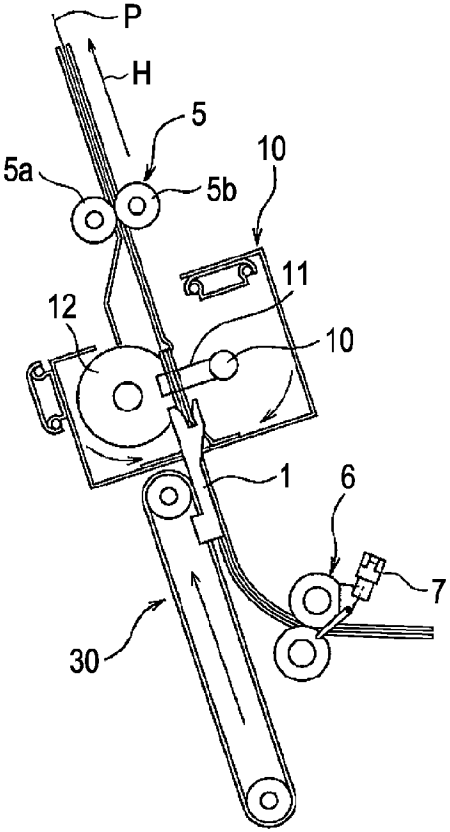
FIG. 6C is an explanatory view showing the operation of the sheet-processing apparatus according to the embodiment, in a state where a rotatable puncher makes holes at predetermined positions when the skew-correcting member pushes the rear end of the sheet and the skew of the sheet is corrected.

Then, as shown in FIG. 6C, the nipping is restored at the downstream conveying roller pair 5 when a predetermined period of time has elapsed, the period extending from the time when the nipping of the downstream conveying roller pair 5 is released to the time when the skew of the sheet is corrected and the sheet is received by the skew-correcting member 1 with the stable posture. Then, the puncher 10 makes the holes in the sheet at a predetermined timing.

Figure 7:
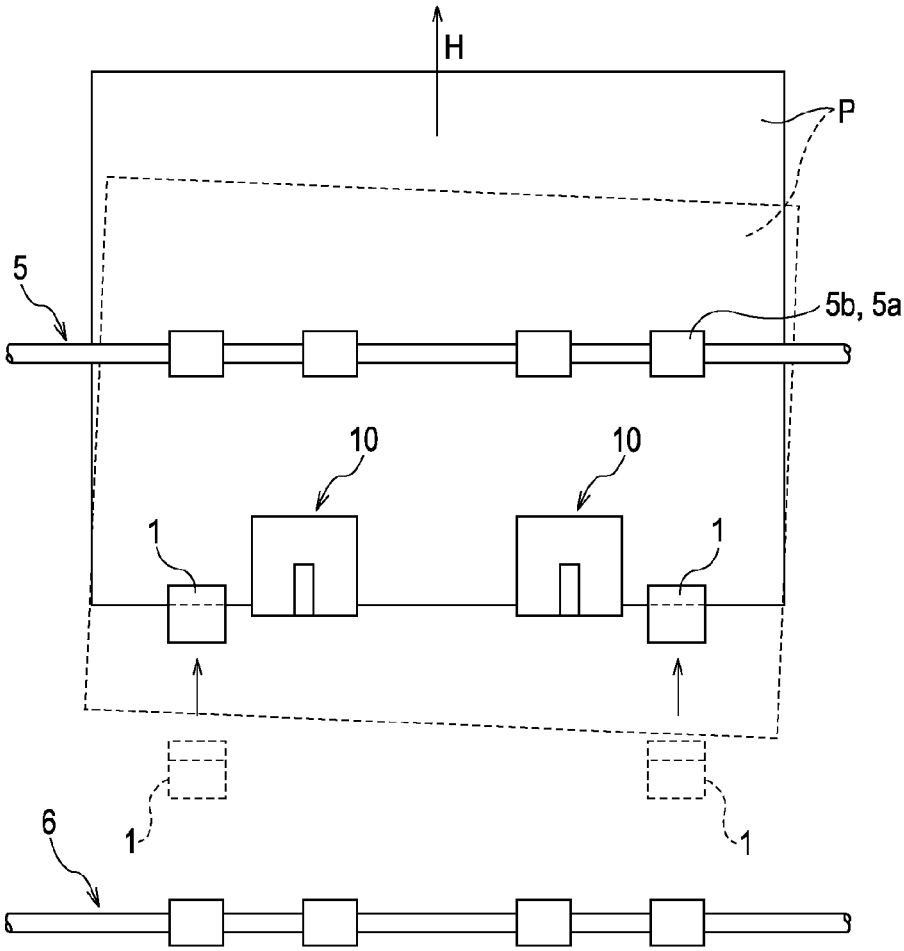
FIG. 7 is a right side view showing the sheet-processing apparatus when the sheet-processing apparatus shown in FIGS. 6A to 6C corrects the skew of the sheet.

As described above, by releasing the nipping of the downstream conveying roller pair 5 once, the skew of the sheet can be easily corrected to the position plotted with the solid line even when the amount of skew is relatively large as plotted with the broken line, in FIG. 7. In addition, the puncher 10 allows the sheet to be aligned at the processing tray 115 located on the downstream side. The sheet is aligned and stacked on the upper supporting tray 122 or the lower supporting tray 118.

Alternatively, the sheet may be conveyed by a rotation belt instead of the downstream conveying roller pair 5.

Figure 8A:
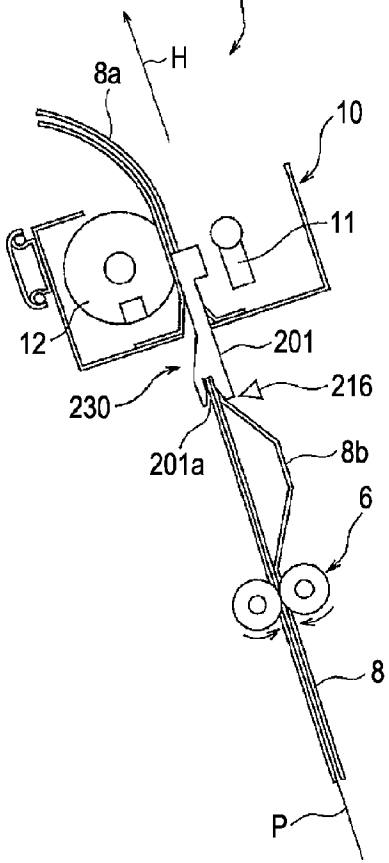
FIG. 8A is an explanatory view showing the operation of a sheet-processing apparatus according to still another embodiment, in a state where a sheet is conveyed through a conveying guide.
Figure 8B:
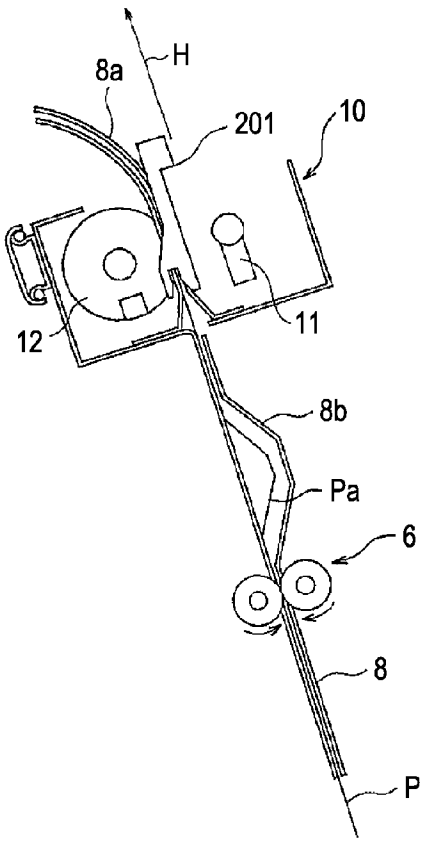
FIG. 8B is an explanatory view showing the operation of the sheet-processing apparatus according to the embodiment, in a state where a skew-correcting member starts moving in a direction indicated by an arrow H at a predetermined timing after a rear end of the sheet passes through a sheet-rear-end detection sensor.
Figure 8C:
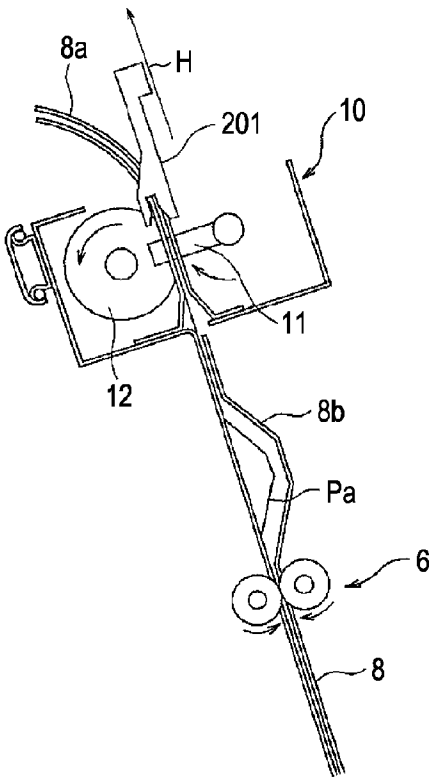
FIG. 8C is an explanatory view showing the operation of the sheet-processing apparatus according to the embodiment, in a state where a rotatable puncher makes holes at predetermined positions when the skew-correcting member pushes the rear end of the sheet and the skew of the sheet is corrected.

A sheet-processing apparatus 200 shown in FIGS. 8A to 8C corrects the skew of the sheet by receiving a front end (downstream end) of the sheet by a skew-correcting member 201 provided reversely to the skew-correcting member 1 shown in FIG. 1. Components similar to those shown in FIG. 1 have the same numerical references, and the description thereof will be omitted.

In FIG. 8A, the skew-correcting member 201 is detected by a skew-correcting member home-position sensor 216, and is in a standby state at the home position on the upstream side of the puncher 10. The skew-correcting member 201 is moved by the skew-correcting member driving motor M3, the pulleys 3 and 4, the timing belt 2 shown in FIG. 1.

When the sheet is conveyed by the upstream conveying roller pair 6, the skew-correcting member 201 receives the front end of the sheet by a sheet receiving portion 201*a*. Then, the skew-correcting member 201 is moved in the direction indicated by the arrow H (sheet-conveying direction).

Figure 9:
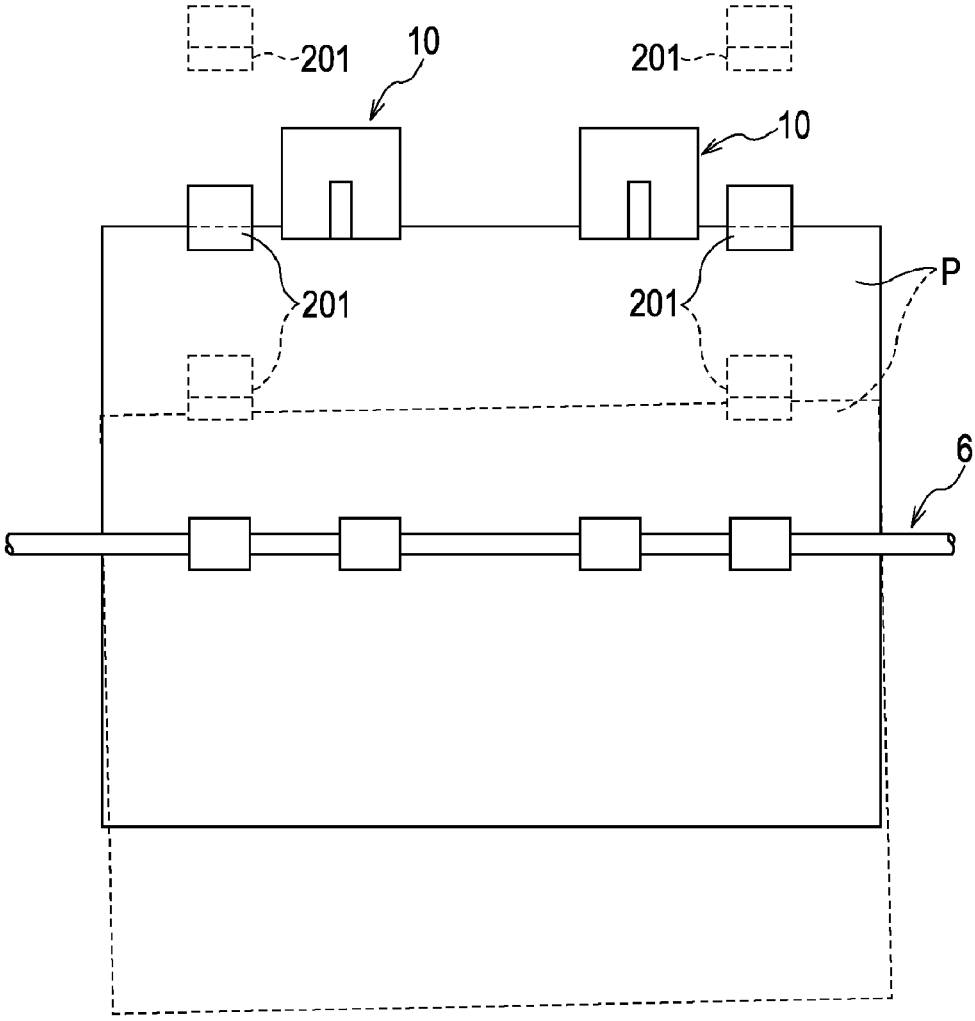
FIG. 9 is a right side view showing the sheet-processing apparatus when the sheet-processing apparatus shown in FIGS. 8A to 8C corrects the skew of the sheet.

As shown in FIGS. 8B and 9, a moving speed V1 of the skew-correcting member 201 is lower than a sheet-conveying speed V2 of the upstream conveying roller pair 6 (V1<V2). Accordingly, the sheet-processing apparatus 200 can correct the skew of the sheet by the skew-correcting member 201 without stopping the conveyance of the sheet. Also, since the degree of bending of the loop formed at the sheet can be adjusted by the sheet-conveying speed resulted from the skew-correcting member 201 and the upstream conveying roller pair 6, the skew can be accurately corrected for various types of sheets.

As shown in FIG. 8C, when the skew-correcting member 201 is moved to the downstream side of the puncher 10 while the skew of the front end of the sheet is corrected, the puncher 10 makes holes in the sheet.

The sheet-processing apparatus 200 can enhance the hole-positioning accuracy when the punching is executed at the front end portion of the sheet. Also, advantages similar to that of the sheet-processing apparatus 100 can be provided. The puncher 10 allows the sheet to be aligned at the processing tray 115 located on the downstream side. The sheet is aligned and stacked on the upper supporting tray 122 or the lower supporting tray 118.

The upstream conveying roller pair 6 may be a slip roller pair for easily correcting the skew of the sheet.

As described above, the pulleys 3 and 4, the timing belt 2, the skew-correcting member 201, the upstream conveying roller pair 6 (sheet-conveying unit), and the like, define a skew-correcting device 230. The combination consisting of the skew-correcting member driving motor for driving the timing belt, the pulleys, and the timing belt, is a merely example of the driving unit.

Alternatively, the sheet may be conveyed by a rotation belt instead of the rotatable upstream conveying roller pair 6.

As shown in FIG. 8C, the sheet-processing apparatus 200 makes the holes at a portion close to the skew-correcting member 201 relative to the loop Pa formed at the sheet and hence having a small degree of bending of the sheet.

The above-described sheet-processing apparatus 200 can provide advantages similar to that of the sheet-processing apparatus 100 shown in FIGS. 1 to 7.

In the case of the embodiment shown in FIGS. 8A to 8C, the upstream conveying roller pair 6 may be a slip roller pair as described in the above embodiment. Also, the nipping of the upstream conveying roller pair 6 may be released.

In the above-described sheet-processing apparatus 100, 200, holes are made in the sheet by a puncher, however, the holes are not necessary to be made. That is, only the skew of the sheet may be corrected. If the skew of the sheet is corrected, the ends of sheets may be easily aligned when the sheets are bound by the stapler unit 116 shown in FIG. 11.

In the above description, while the embodiment in which the skew-correcting device is applied to the sheet-processing apparatus is described, the skew-correcting device may be applied to any device that conveys a sheet.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-148914 filed May 29, 2006, which is hereby incorporated by reference herein in its entirety.

What is claimed is:

1. A sheet processing apparatus comprising:

a sheet-conveying unit configured to convey a sheet in a sheet-conveying direction;

a conveying path through which a sheet conveyed by the sheet-conveying unit is conveyed;

a skew-correcting member having a contacting portion that contacts with an end of the sheet conveyed and configured to correct skew of the sheet by contacting the end of the sheet, the skew-correcting member is movable so that the contacting portion moves along the conveying path in the sheet-conveying direction;

a rotatable puncher, provided between the sheet-conveying unit and the skew-correcting member, configured to punch the sheet, a driving unit configured to move the skew-correcting member so that the contacting portion of the skew-correcting member contacts the end of the sheet being conveyed in the sheet conveying direction by the sheet-conveying unit, and the driving unit moves the contacting portion of the skew-correcting member along the conveying path in the sheet-conveying direction at a speed that is different from a sheet-conveying speed of the sheet-conveying unit in a state in which the contacting portion of the skew correcting member contacts the end of sheet being conveyed in the sheet conveying direction, and wherein the rotary puncher punches the sheet contacting the contacting portion of the skew-correcting member moved by the driving unit.

2. The sheet processing apparatus according to claim 1, wherein the skew-correcting member is disposed on an upstream of the sheet-conveying unit, and the driving unit moves the skew-correcting member at a speed higher than a sheet-conveying speed of the sheet-conveying unit.

3. The sheet processing apparatus according to claim 1 wherein, the sheet-conveying unit includes a rotation body pair that nips and conveys the sheet, and the rotation body pair releases nipping of the sheet once after the skew-correcting member contacts the end of the sheet.

4. The sheet processing apparatus according to claim 1, wherein the skew-correcting member contacts an upstream end of the sheet in the conveying direction.

5. The sheet-processing apparatus according to claim 1, wherein a loop is formed at the sheet by utilizing the difference between the moving speed of the skew-correcting member and the sheet-conveying speed of the sheet-conveying unit, so as to correct the skew of the sheet, and the rotatable puncher punches the sheet on a side of the skew-correcting member relative to the loop formed at the sheet.

* * * * *